US006668509B1

(12) United States Patent
Krebs

(10) Patent No.: US 6,668,509 B1
(45) Date of Patent: Dec. 30, 2003

(54) REUSABLE ROOF ANCHOR FOR SAFETY LINES

(76) Inventor: Dale Joseph Krebs, 17 W. Woolman, Butte, MT (US) 59701

( * ) Notice: Subject to any disclaimer, the term of this patent is extended or adjusted under 35 U.S.C. 154(b) by 0 days.

(21) Appl. No.: 10/193,851

(22) Filed: Jul. 11, 2002

(51) Int. Cl.[7] ..... E04C 5/00
(52) U.S. Cl. ..... 52/698; 52/703; 248/499
(58) Field of Search ..... 52/698, 703, 24, 52/27, 645, DIG. 12, 712; 182/45; 248/240, 241, 247, 300, 505, 499; 16/386, 387, 223

(56) References Cited

U.S. PATENT DOCUMENTS 1,112,888 A * 10/1914 Burchess ..... 16/387
4,249,713 A * 2/1981 Glynn et al. ..... 248/237
4,455,711 A * 6/1984 Anderson ..... 16/229
4,570,290 A * 2/1986 Anderson ..... 16/229
5,143,171 A * 9/1992 Glynn et al. ..... 182/3
5,287,944 A * 2/1994 Woodyard ..... 182/3
5,361,558 A * 11/1994 Thornton et al. ..... 52/698
5,730,407 A * 3/1998 Ostrobrod ..... 248/237
5,845,452 A * 12/1998 Pantano ..... 52/698
5,896,719 A * 4/1999 Thornton ..... 52/698

* cited by examiner

*Primary Examiner*—Carl D. Friedman
*Assistant Examiner*—Jennifer I. Thissell

(57) ABSTRACT

The reusable roof anchor presents a novel approach for attaching a safety line to prevent the injury of workers while working on a roof. None of the devices in the prior art combine a reusable structure that can be adapted to any pitch of roof while providing maximum range of motion. The unique structure that joins a mounting platform with an attachment device by a pivoting joint enables this device to achieve this unique combination of benefits. Also unique to this design is the combination of the above attributes with an easy method of installation and removal. This design recognizes and addresses the four most important aspects that such a device must provide: safety, ease of installation and removal, adaptability, and range of motion. While other devices in the prior art address these concerns individually or partially, none address all four. Thus the reusable roof anchor for safety lines provides a major improvement in the safety of workers in the roofing industry.

20 Claims, 3 Drawing Sheets

REUSABLE ROOF ANCHOR FOR SAFETY LINES

BACKGROUND OF THE INVENTION

1. Field of the Invention

The present invention relates to an inexpensive, reusable anchor that is adaptable to most roofs and provides a connecting point for a safety line.

2. Description of the Prior Art

A primary concern of any worker that must perform tasks atop a roof is the danger of falling and hurting themselves. A common problem in the roofing industry is injury due to accidents, some of which have been very severe. The United States Government has recognized this danger and has passed regulations requiring fall prevention systems. In order to prevent these injuries, roofers often wear safety harnesses that are connected to the roof by a safety line. If the user should lose his footing the safety line will prevent him from falling. The difficulty presented by this arrangement is the connecting of the safety line to the roof. This connection must be secure enough to withstand the force exerted by the safety line when the user's weight is thrust against it. It is also desirable that the connection can be easily adapted to the wide variety of pitches that exist in the design of roofs. The connection should be as easy and quick to install as possible since the user cannot be fully secured until this has been accomplished. It should also be removable so that the device can be used on new jobs. This feature is important since the economics of the industry require minimizing costs as much as possible Workers on roofs require as much freedom of movement as possible to perform their tasks. Any connecting device should allow the user to move freely in a three hundred and sixty degree arc. Limitations on this movement would severely burden their already difficult tasks. It should also allow this movement without risking any entangling of the safety line.

There are inventions currently in existence for the anchoring of a safety line to a roof, but each of these have faults that make them impractical for the many jobs and types of roofs that the average roofer faces. Many designs involve a safety attachment that is permanently incorporated in the design of the roof. While this is an ideal situation, many older houses will not have this feature. It may also be deemed aesthetically undesirable to have such a feature. On the opposite end of the spectrum are the prevalent disposable anchors that are designed for one time use. These are an unnecessary recurring economic burden on roofers and lack the flexibility and ease of the present invention. All of the remaining designs lack the maximum adaptability and freedom that the present invention affords the user.

U.S. Pat. No. 5,878,534 to David Gleave is an example of devices existing in the prior art that are permanently incorporated into the structure of the roof. These building components are designed in a variety of ways to be fitted to common structural supports in a roof such as trusses, roof ridges and gutter systems. While the security of such a design is evident, as a practical mater it hardly aids the average roofer working on pre-existing structures. The device then incorporates a loop for connecting the safety line. In order to allow mobility for the user, the Gleave '534 Patent discloses a complicated traveler and rail system. This system would be much more expensive to make then the present invention and would afford no greater mobility. It would also require maintenance to prevent blocking of the rail system and could easily jam.

U.S. Pat. No. 5,845,452 to Marcel Peter Pantano discloses an anchoring system that straddles the peak of a roof and is attached on either side like the present invention. It is however made in a permanent shape with a flat inflexible central portion. Unlike the hinged design of the present invention, the Pantano '452 device would be limited to roofs having a specific pitch. The Pantano device also uses attachments that connect to the arms that straddle the roof and limit use to that side of the roof where the attachment is placed. This is in contrast to the unique structure provided by the present invention that provides a centrally located hoop that is hinged so as to allow the safety line to pass from the connection in any direction.

U.S. Pat. No. 5,361,558 to Stacy Thornton also discloses a design that straddles a roof peak and is attached on either side. The legs of this design extend at an angle from one another. The device can be conformed to any pitch of roof by bending the legs towards one another at the central point of the angle. The draw back to this approach is that the anchor can only be adapted one time and will therefore be of no use to a roofer on a new job with a different pitch. The point of attachment is once again located on either side of the roof so as to limit the user to a one hundred and eighty degree range of motion.

United States Patent to Dennis Bredijk discloses a complicate scaffolding device that is attached to the roof using an anchoring system that involves a bracket that is placed over the peak of a roof and uses a ballast block to secure it. This method of attachment would not provide the level of security that exists in the multiple nail down design of the present invention and only allows for attachment to one side of the roof at one time whereas the present invention connects at a central location.

U.S. Pat. No. 5,248,021 to Steve Nichols is an anchoring device that relies on a bracket that incorporates two parallel sides that attach on either side of a rafter and have a connector extending upward. This design provides a permanent device that would require access to the rafters of the roof, thus necessitating either installation at the time of building or major deconstruction to install.

U.S. Pat. No. D440,672 to Richard Alexander is a design patent for a roof anchor device. Unlike the present invention, it uses a permanently flat structure that could only be attached to one side of the roof. The connection is mounted to this flat structure by a stitched material that would not provide the level of support existing in the metallic hinged design of the present invention.

Therefore a need exists for a novel and enhanced tool for anchoring workers during the strenuous and dangerous task of doing roof work. Such a device should be as economical as possible and adaptable to many shapes of roof. In addition it should be designed to install easily and quickly. It should maximize the mobility of the user while providing sufficient support for large weights. In this respect, the reusable roof safety line anchor according to the present invention substantially departs from the conventional concepts and designs of the prior art, and in doing so provides an apparatus primarily developed for the purpose of connecting a safety line to a roof structure.

SUMMARY OF THE INVENTION

In view of the foregoing disadvantages inherent in the known types of devices for anchoring safety lines to a roof now present in the prior art, the present invention provides an improved combination of economy, security and adaptability, and overcomes the abovementioned disadvantages and drawbacks of the prior art. As such, the general purpose of the present invention, which will be described subsequently in greater detail, is to provide a new and improved reusable roof anchor for safety lines which has all of the advantages of the prior art mentioned heretofore and many novel features that result in a reusable roof anchor for safety lines which is not anticipated, rendered obvious, suggested, or even implied by the prior art, either alone or in combination thereof.

In furtherance of this objective, the reusable roof anchor for safety lines comprises a pair of flat rectangular mount flaps designed for removable attachment to a roof. Said pair of flat rectangular mount flaps are connected by an axle which incorporates a C-shaped member for attaching a security line. The angle formed by said pair of flat rectangular mount flaps can be adjusted to any size by rotating them about said axle.

There has been outlined, rather broadly, the more important features of the invention in order that the detailed description thereof that follows may be better understood and in order that the present contribution to the art may be better appreciated.

The axle in said present invention may in addition comprise a pair of pins that are attached to either end of a C-shaped member. This design will provide a central attachment site that can shift to allow maximum freedom of movement by rotationally adjusting to the location of the user. Said pair of pins will be received by a set of hinges connected to said flaps. Said flaps will movably rotate about said axle to allow adjustment to any pitch of roof.

An additional aspect of the reusable roof anchor for safety lines is that the above-described flaps will comprise a series of holes. Said holes are shaped to receive the standard carpenter's nail. The preferred pattern is a set of rows with the holes staggered to provide the maximum resistance to force applied by a security line.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved reusable roof anchor for safety lines that has all of the advantages of the prior art and none of the disadvantages.

It is another object of the present invention to provide a new and improved reusable roof anchor for safety lines that may be easily and efficiently manufactured and marketed.

An even further object of the present invention is to provide a new and improved reusable roof anchor for safety lines that has a low cost of manufacture with regard to both materials and labor, and which accordingly is then susceptible of low prices of sale to the consuming public, thereby making such reusable roof safety line anchor s economically available to the buying public.

Still another object of the present invention is to provide a new reusable roof anchor for safety lines that provides in the apparatuses and methods of the prior art some of the advantages thereof, while simultaneously overcoming some of the disadvantages normally associated therewith.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
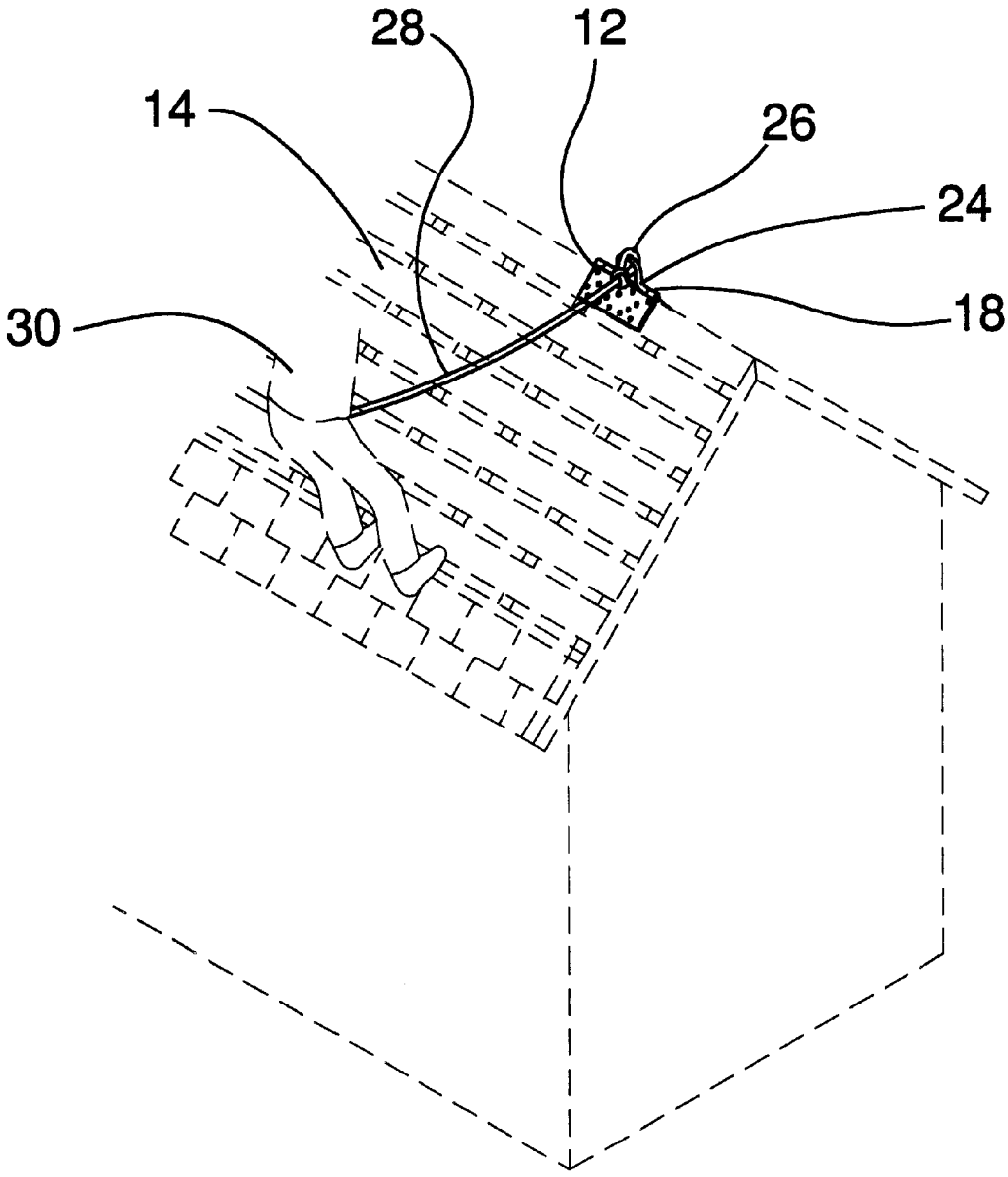
FIG. 1 is a top perspective view of a roof with the reusable roof anchor for safety lines attached.

Referring now to the drawings, and particularly to FIGS. 1–5, a preferred embodiment of the reusable roof anchor for safety lines of the present invention is shown and generally designated by the reference numeral 10.

In FIG. 1 is a view of the reusable roof anchor for safety lines 10 in use. Shown is the first of two mount flap platforms 12 comprising a rectangular shape and having a large width and length and a narrow breadth. This design consists of two large flat surfaces divided by a narrow distance so as to allow a standard carpenter's nail 32 to pass through and between said surfaces and penetrate the surface of the roof 14 to an adequate depth for securing said anchor 10. In this figure the upper flat surface of said mount flap platform 12 is visible and comprises several holes 16 that are spaced evenly apart in rows so that each row is staggered. The lower surface of said mount flap 12 is flush against the upper surface of said roof 14 with its upper edge adjacent to the apex of said roof 14. The holes receive nails 32, which pass through them and penetrate the roof 14 so as to provide a firm grip with the surface. The large flat surface combined with the arrangement of said holes maximizes the gripping capacity of the present invention. It should be noted that this design could easily accommodate other standard fasteners such as screws or bolts. In addition, it could incorporate other attachment devices such as clamps or tie downs.

The materials that can be used for the abovementioned flaps 12 are numerous and should not be narrowed by the following suggestions. Said flaps 12 could be easily and cheaply made using easily shaped metal such as steel or aluminum. Other materials that might be used are strong woods or hard plastics. These materials suit the needs of being easily shaped into the desired form while having tensile strength capable of withstanding large forces without breaking. For special roof designs that might require different shapes said flap 12 could be made in a wide variety of shapes having an upper edge long enough to accommodate the present inventions uniquely hinged design.

In FIG. 1 and attached to the upper edge of said flap 12 is a pair of hinges 18. Said hinges 18 comprise a cylindrical shape that has an inner bore 20. Said bore 20 receives a pin 22 that also passes through the bore of a hinge attached to said second mount flap platform, thus creating a rotational attachment between said mount flap platforms 12. The hinges could be easily formed from the same metal or plastic piece that embodies said mount flap platforms 12. Metal flanges could be formed at the upper edge of said flaps 12 if it consisted of metal. These flanges could then be bent into the cylindrical shape of said hinge 18. Alternately, if said flap 12 consisted of plastic then the molded piece could include said cylindrical shapes at the upper edge. The number of said hinges 18 could be easily varied if this would be better suited to a particular need.

In FIG. 1 a view of a C-shaped member 24 is shown located at the center of said mount flaps 12 and attached to said pins 22. Said C-shaped member 24 receives an attachment device 26 that is connected to a safety line 28 which is further connected to a worker 30. The C-shaped member 24 is supported by said mount flap platforms 12 that straddle the peak of said roof 14 and provide an immovable link between said 28 safety line and said roof 14. It is important to note that, because said C-shaped member 24 is attached to said mount flaps 12 by its connection with said pins 22, it can shift rotationally with the direction of said safety line 28. This design allows for maximum range of use. Said C-shaped member 24 and said pins 22 can be incorporated into one solid piece and can be made of strong materials that can be easily shaped such as metal or plastic. Alternatively they can be made of separate materials for particular needs. Such needs might include an alternate design to replace said C-shaped member 24 to accommodate a unique safety line attachment system. A heavy-duty cord could also replace said C-shaped member 24 if this flexibility would be preferred.

Figure 2:
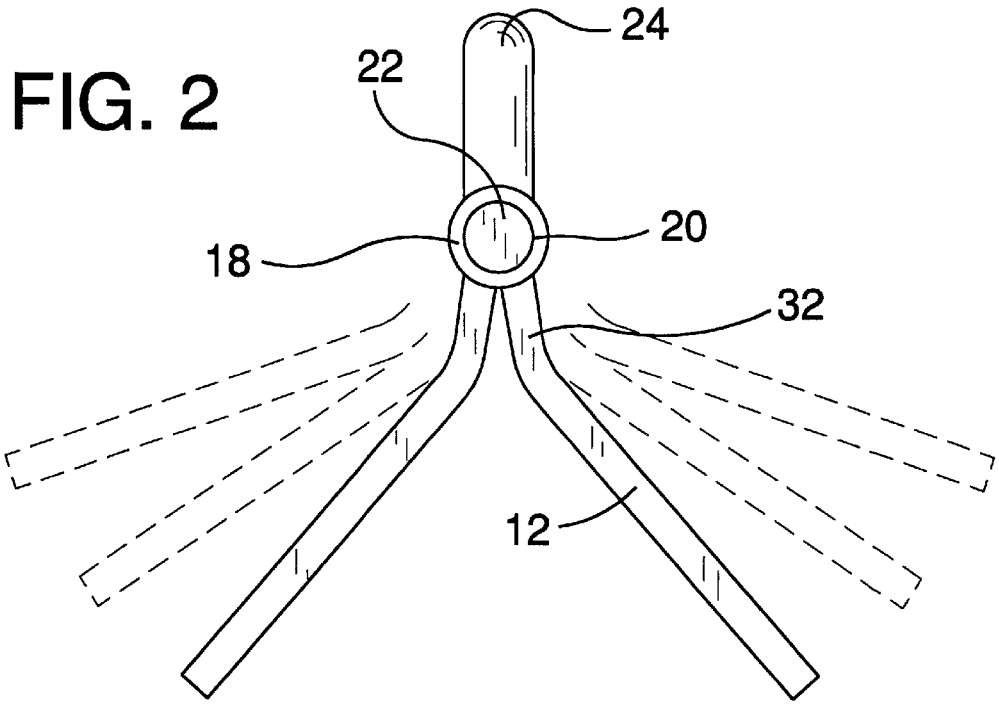
FIG. 2 is a right side view of the reusable roof anchor for safety lines illustrating the adjustable movement of the flaps.

In FIG. 2 a side view of said reusable roof anchor for safety lines 10 is shown and demonstrates the rotational motion of said flaps about the hinged design. Shown is a view of the end of a cylindrical hinge 18 and the bore 20 that it comprises. Also shown is the end of one of said pins 22. Said pin 22 and cylindrical hinge 18 combination allows for the angle between said flaps 12 to be adjusted to any size, thus accommodating any pitch of roof. At the top of said reusable roof safety line anchor 10 is shown a side view of said C-shaped member 24. Also shown in FIG. 2 is a bend 34 in said mount flaps at the upper edge adjacent to said cylindrical hinges 18. Said bend 34 can be varied or excluded from the design if needed for particular uses.

Also shown in FIG. 2 is the outer view of the side of said C-shaped member 24. Said member has a curved upper surface and connects to said mount flaps 12 by connection to said pins 22 that penetrate said cylindrical hinges 18. The side of the cylindrical body of said hinge 18 is shown comprising an inner bore 20. Also shown is the end of one of said pins 22 whose end is inserted into said cylindrical hinge 18. Said end 22 could be closed in an alternate design. This design coordinates a hinged union of mount flaps 12 with a hinged seating for said C-shaped member 24. This unique design serves two important purposes. The first is that said mount flaps 12 can be adjusted to any angle, accommodating any pitch of roof. The second is that said C-shaped member 12 will rotate from side to side adjusting to the direction it is pulled by said safety line 28. This important feature facilitates maximum range of movement for the user.

Figure 3:
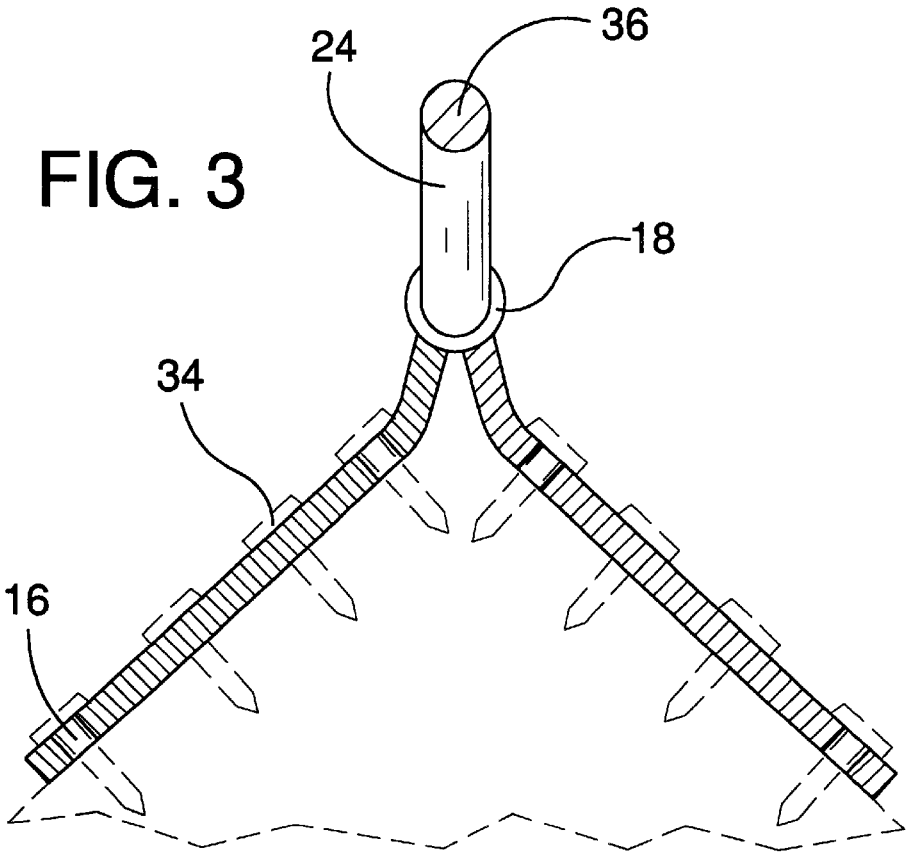
FIG. 3 is a cross-sectional right side view of the reusable roof anchor for safety lines.

In FIG. 3 a right side cross-sectional view of said reusable roof anchor for safety lines 10 is shown. This view is sliced down the middle of the present invention and through the center of the upper level and lower level row of said holes 16 for receiving nails 32. The staggering of said holes 16 is illustrated by the inner rows that are not sliced by this view. In the preferred embodiment, the diameter of said holes 16 would be large enough to allow the passing of a common carpenter's nail and would be smaller then the diameter of the head of said nails. Under this design, the mount flap 12 would be sandwiched between the head of said nails 32 and the upper surface of said roof 14. This will create a firm bond between the mount flap 12 and the roof 14. Said holes can be sized to receive any common fastener such as a screw or bolt and can be arranged according to any desirable pattern. An alternate design might include threading on the to inner surface of said holes 16 allowing for the attachment of a bolt. Said bolt would comprise a head that would enter through the lower surface of said roof 14 and would sandwich said roof between said mount flap 12 and said head of said bolt.

Also shown in FIG. 3 is a sectional view of said C-shaped member 24. In the preferred embodiment said member 24 would have a circular cross section 36 that could be substituted by any desirable shape. The upper portion of said C-shaped member 24 would be parallel to the upper edge of said mount flaps 12 and would extend downwards towards said flaps 12. At the point where said C-shaped member 24 connects to said pins 22, said C-shaped member 24 would have a bend 32 outward creating a smooth transition to said pins 22. The inner edge of said cylindrical hinges 18 is pictured. The upper edge of said mount flaps 12 is connected to the lower outer surface of said cylindrical hinge 18. Said cylindrical hinge 18 comprises an opening and a bore 20. Said pins 22 enter said 20 bore via said opening and are connected to said C-shaped member 24.

Figure 4:
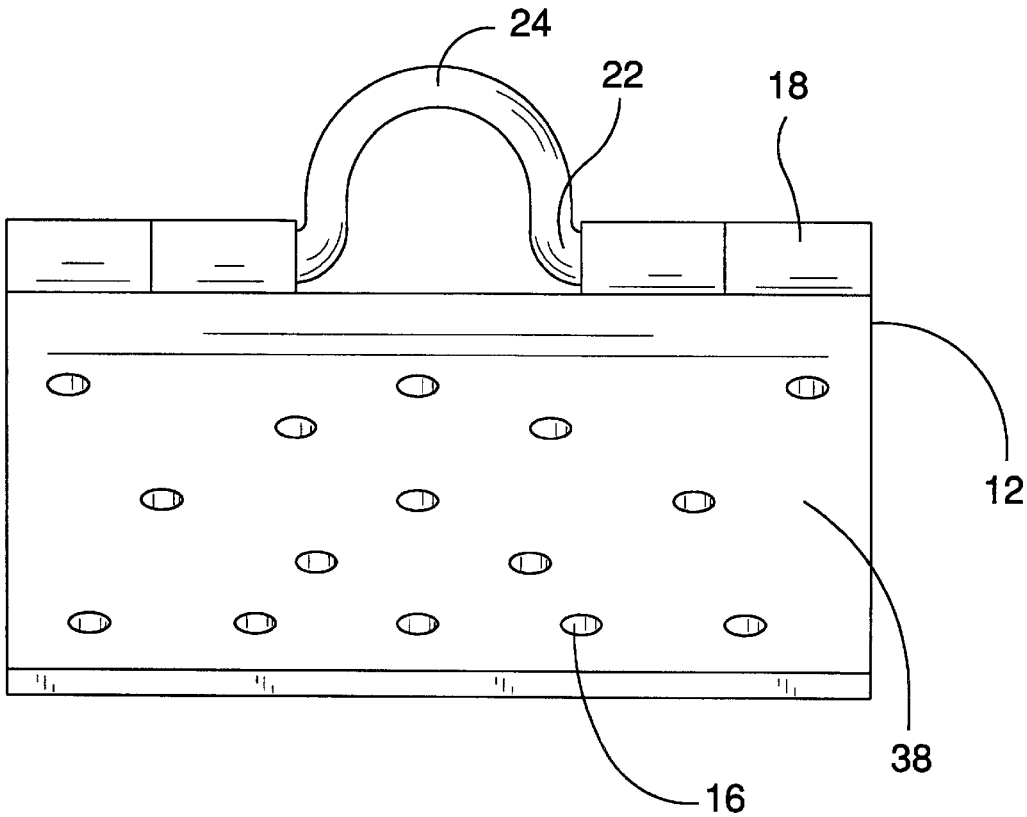
FIG. 4 is a front side view of the reusable roof anchor for safety lines.

In FIG. 4 a side view illustrates said upper surface 38 of said mount flap 12 when both flaps are fully retracted so that said lower surfaces of said mount flaps 12 are flush. Said upper surface 38 comprises a rectangular shape that could be substituted by alternate shapes. The pattern of holes 16 illustrated is the preferred embodiment where the holes are placed in rows that are staggered. This arrangement creates maximum gripping capacity. Alternately, this pattern could be modified to suit uniquely shaped surfaces if roof designs so dictates. Said holes 16 pictured have an oval shape and would be large enough to receive a standard carpenter's nail 34 while blocking the passage of the head of said nails 34.

Also pictured in FIG. 4 are said cylindrical hinges 18. This view illustrates the outer surface of said hinges 18 and has a rectangular outline. Four hinges are pictured, two of which would be connected to one of said mount flaps 12 while the remaining two would be connected to the other said mount flap. The location of said hinges 18 is so that there are two outer hinges and two inner hinges. Any combination of these could be divided into the two pairs of hinges connected to each mount flap. A design where one outer hinge and the opposite inner hinge are connected to each mount flap 12 would create an interlocking design that would be desirable in some circumstances. The number of said cylindrical hinges 18 need not be limited to four. The shape of the outer surface can also be varied so long as said inner bore is cylindrical to receive said pins 22.

FIG. 4 demonstrates said C-shaped member 24 located at the center of the upper edge of said mount flap 12 and between the inner edged of said cylindrical hinges 18. The connection between said C-shaped member 24 and said pins 22 is depicted as a bend at the outer ends of said C-shaped member 24 that extends outward to meet with said pins 22. This design can consist of a single unit incorporating each pin 22 and said C-shaped member 24 or could have separate parts if necessary. The design of said C-shaped member 24 easily accommodates the connecting of a standard safety line attachment device such as a carbiner. The shape of said member 24 could be varied to suit unique needs or could be replaced by an attachment device for specific safety line union devices that utilize a latch or clipping mechanism.

While a preferred embodiment of the reusable roof anchor for safety lines 10 has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention. For example, any suitable resilient material could be substituted for the above described metals and plastics. And although the use in the field of roofing has been described, there are slight variations, such as shape and size that would make the invention appropriate for other tasks involving the risk of falling.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reusable roof anchor for safety lines comprising:

a first mount flap platform having opposing ends, wherein said first mount platform defines plurality of holes therein and has one of said ends bent at an angle;

a pivot attached to said first mount flap platform;

a hook attached to said pivot;

a second mount flap platform having opposing ends, wherein said second mount platform defines a plurality of holes therein, is attached to said pivot, and has one of said ends bent at an angle.

2. The reusable roof anchor for safety lines of claim 1 wherein said first and said second mount flap platforms comprise a cylindrical column and wherein said cylindrical column comprises a bore.

3. The reusable roof anchor for safety lines of claim 1 wherein said hook comprises a C-shaped member.

4. The reusable roof anchor for safety lines of claim 1 wherein said hook comprises a pin.

5. The reusable roof anchor for safety lines of claim 1 wherein said first mount flap platform and said second mount flap platform comprise a rectangular shape.

6. The reusable roof anchor for safety lines of claim 1 wherein said first mount flap platform and said second mount flap platform comprise an upper and a lower surface and wherein said upper and lower surfaces are separated by a distance not to exceed one-half of an inch.

7. The reusable roof anchor for safety lines of claim 1 wherein said holes are arranged in rows and wherein said holes are staggered.

8. The reusable roof anchor for safety lines of claim 1 wherein said first and said second mount flap platforms comprise a cylindrical column and wherein said cylindrical column comprises a bore and wherein said hook comprises a pin.

9. A reusable roof anchor for safety lines comprising:

a first mount flap platform having opposing ends, wherein said first mount platform defines a plurality of holes therein and has one of said ends bent at an angle;

a pivot attached to said first mount flap platform;

a latch attached to said pivot;

a second mount flap platform having opposing ends, wherein said second mount platform defines a plurality of holes therein, is attached to said pivot, and has one of said ends bent at an angle.

10. The reusable roof anchor for safety lines of claim 9 wherein said first and said second mount flap platforms comprise a cylindrical column and wherein said cylindrical column comprises a bore.

11. The reusable roof anchor for safety lines of claim 9 wherein said latch comprises a pin.

12. The reusable roof anchor for safety lines of claim 9 wherein said first mount flap platform and said second mount flap platform comprise a rectangular shape.

13. The reusable roof anchor for safety lines of claim 9 wherein said first mount flap platform and said second mount flap platform comprise an upper and a lower surface and wherein said upper and lower surfaces are separated by a distance not to exceed one half of an inch.

14. The reusable roof anchor for safety lines of claim 9 wherein said holes are arranged in rows and wherein said holes are staggered.

15. The reusable roof anchor for safety lines of claim 13 wherein said first and said second mount flap platforms comprise a cylindrical column and wherein said cylindrical column comprises a bore.

16. The reusable roof anchor for safety lines of claim 13 wherein said hook comprises a C-shaped member.

17. The reusable roof anchor for safety lines of claim 13 wherein said hook comprises a pin.

18. The reusable roof anchor for safety lines of claim 13 wherein said first mount flap platform and said second mount flap platform comprise a rectangular shape.

19. The reusable roof anchor for safety lines of claim 13 wherein said first mount flap platform and said second mount flap platform comprise an upper and a lower surface and wherein said upper and lower surfaces are separated by a distance not to exceed one half of an inch.

20. A reusable roof anchor for safety lines comprising:

a first mount flap platform having opposing ends with one end comprising a clamp, wherein said end of said first mount flap platform adjacent to said clamp is bent at an angle;

a pivot attached to said first mount flap platform;

a hook attached to said pivot such that said hook and said pivot are unitary; and a second mount flap platform having opposing ends with one end comprising a clamp and attached to said pivot, wherein said end of said second mount flap platform adjacent to said clamp is bent at an angle.

* * * * *